United States Patent [19]

Kurimsky

[11] 4,257,657

[45] Mar. 24, 1981

[54] READILY RELEASABLE MECHANISM FOR LOCKING A MERCHANDISING MACHINE DOOR IN OPEN POSITION

[75] Inventor: Albert Kurimsky, Denville, N.J.

[73] Assignee: Rowe International, Inc., Whippany, N.J.

[21] Appl. No.: 937,335

[22] Filed: Aug. 28, 1978

[51] Int. Cl.[3] ..... A47B 81/00; E05C 17/32; B65D 43/24

[52] U.S. Cl. ..... 312/291; 312/294; 312/319; 220/335; 292/263; 108/81; 16/80

[58] Field of Search ..... 312/294, 291, 319, 35, 312/139; 16/80, 72; 220/335; 108/81, 82; 292/263, 338

[56] References Cited

U.S. PATENT DOCUMENTS

| | | | |
|---|---|---|---|
| 1,717,605 | 6/1929 | Heise | 312/319 |
| 1,784,588 | 12/1930 | Green | 312/319 |
| 1,790,406 | 1/1931 | Cooper | 16/72 |
| 2,042,954 | 6/1936 | Memmel | 16/72 |
| 2,072,525 | 3/1937 | Mann | 292/263 |
| 2,220,766 | 11/1940 | Hubbs | 292/263 |
| 2,284,003 | 5/1942 | Luppert | 108/81 |
| 2,769,213 | 11/1956 | Stetson | 16/80 |
| 2,783,492 | 3/1957 | Duncan | 16/80 |
| 3,388,954 | 6/1968 | Smith | 312/319 |
| 3,563,592 | 2/1971 | Preston | 292/263 |
| 3,820,866 | 6/1974 | Kaldenberg | 312/319 |
| 3,990,754 | 11/1976 | Pitel et al. | 312/291 |
| 4,103,608 | 8/1978 | Chenot | 220/335 |

*Primary Examiner*—Victor N. Sakran
*Attorney, Agent, or Firm*—Shenier & O'Connor

[57] ABSTRACT

A releasable locking mechanism for maintaining the door of a merchandising machine in an open position for loading or servicing. Respective link arms pivotally interconnected at one end are pivotally coupled at their other ends to the door and to the cabinet for movement to an aligned position limiting further movement of the door away from the cabinet. A spring biases one of the arms from its aligned position against a stop to provide an automatic locking action, while an extension of the link arm coupled to the door permits ready kick release of the arms from their locking position.

7 Claims, 3 Drawing Figures

READILY RELEASABLE MECHANISM FOR LOCKING A MERCHANDISING MACHINE DOOR IN OPEN POSITION

BACKGROUND OF THE INVENTION

In the merchandising machine art, the machine cabinet is provided with a door which usually covers the entire open front of the cabinet. Many merchandising machines of the prior art are provided with shelves each of which carries a plurality of merchandise delivery units. Each shelf is mounted in the cabinet for movement between a housed position and a position out of the cabinet at which the units thereof are accessible for loading. Owing to the leading opration described hereinabove, the door of the merchandise machine must be capable of movement to a fully open position to permit the shelves to be moved to loading position. Not only are merchandising machine doors heavy because they are relatively large, but also in many instances they carry mechansims such as minor item dispensing units which add to the weight of the door.

In view of the construction and operation of merchandising machines described hereinabove, it will be appreciated that any movement of the door from its fully open position to its closed position during servicing or loading may result in injury to the serviceman or damage to a tray being loaded or both. Even if neither injury nor damage can result, the consequent annoyance and inconvenience of such a movement of the door renders servicing more difficult. It will be appreciated that a door may inherently have a tendency to move in the manner described. Alternatively, such a movement might be produced accidentally by an individual in the vicinity of the machine.

From the discussion hereinabove, the desirability of maintaining the door in an open position away from the cabinet when loading or servicing merchandising machines will readily be appreciated. It is further desirable that such a means operate automatically and be easily releasable from a locked position.

SUMMARY OF THE INVENTION

One of the objects of my invention is to provide a mechanism which locks the door of a merchandising machine in an open position away from the cabinet.

Another object of my invention is to provide a locking mechanism for the door of a merchandising machine which locks the door automatically when it is fully opened.

Still another object of my invention is to provide a locking mechanism for the door of a merchandising machine which is readily releasable from a locking position.

Other and further objects of my invention will be apparent from the following description.

In general, my invention contemplates a releasable mechanism for locking the door of a merchandising machine in an open position in which respective links pivotally interconnected at one end of each are pivotally coupled at their other ends respectively to the door and to the cabinet for movement to an aligned position limiting further outward movement of the door. A spring biases one of the arms from its aligned position against a stop to provide an automatic toggle locking action as the door moves to its fully open position. Preferably, the links are disposed near the bottom of the door with the arm coupled to the door being formed with an extension to permit ready kick release of the arms from their locking positions against the action of the spring.

BRIEF DESCRIPTION OF THE DRAWINGS

In the accompanying drawings to which reference is made in the instant specification and in which like reference characters are used to indicate like parts in the various views:

FIG. 3 is a fragmentary section of the machine shown in FIG. 1, taken along the line 3—3 of FIG. 1, and drawn on an enlarged scale to illustrate my locking mechanism with the machine door closed.

DETAILED DESCRIPTION OF THE PREFERRED EMBODIMENT

Figure 1:
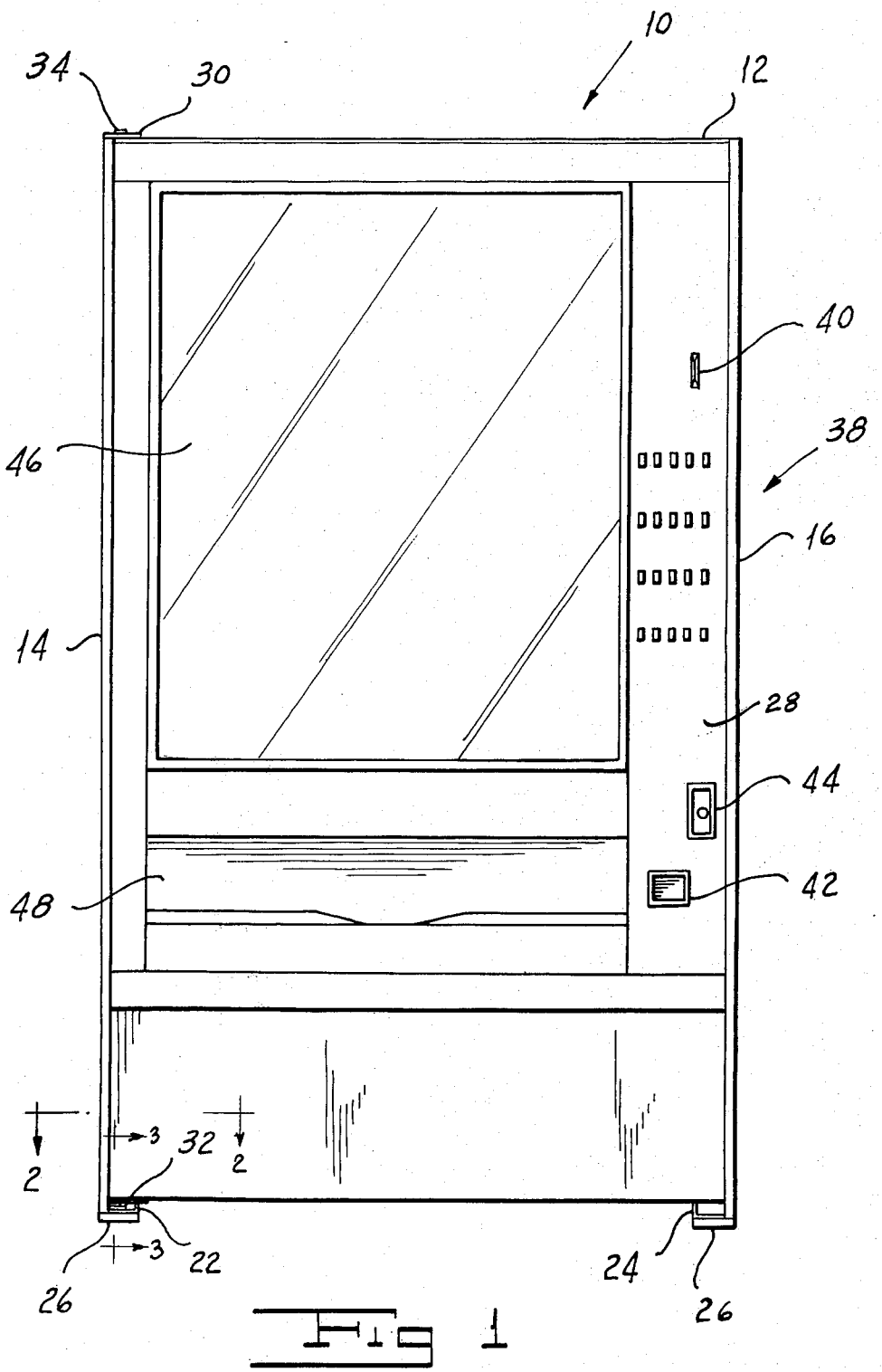
FIG. 1 is a front elevation of a merchandising machine incorporating my readily releasable mechanism for locking a merchandise machine in open position.

Referring now to the drawings, a merchandising machine in which my locking device may be used, indicated generally by the reference numeral 10, includes a cabinet 12 having a left side 14 and a right side 16. A reinforcing channel 18 extends along the front inner wall of each of the side panels 14 and 16 adjacent to the front edges thereof. Respective channels 22 and 24 extending along the lower edges of the left and right sides 14 and 16 support a bottom wall 20 extending between the sides. One or more pairs of feet 26 space the channels 22 and 24 from the floor or other surface on which the machine 10 is set.

Respective upper and lower hinges 30 and 32 support a door 28 for swinging movement away from the cabinet 12 on a vertical axis defined by respective upper and lower pins 34 and 36. Door 28 carries a pushbutton array 38 for selecting purchases, a coin slot 40, a coin return slot 42, a lock 44, a display window 46, and a delivery box 48. While the internal construction of the merchandising machine 10 forms no part of my invention, typical machines with which my locking mechanism may be used are shown in Pitel et al U.S. Pat. No. 3,990,754 and Krakauer U.S. Pat. No. 4,087,020.

Figure 2:
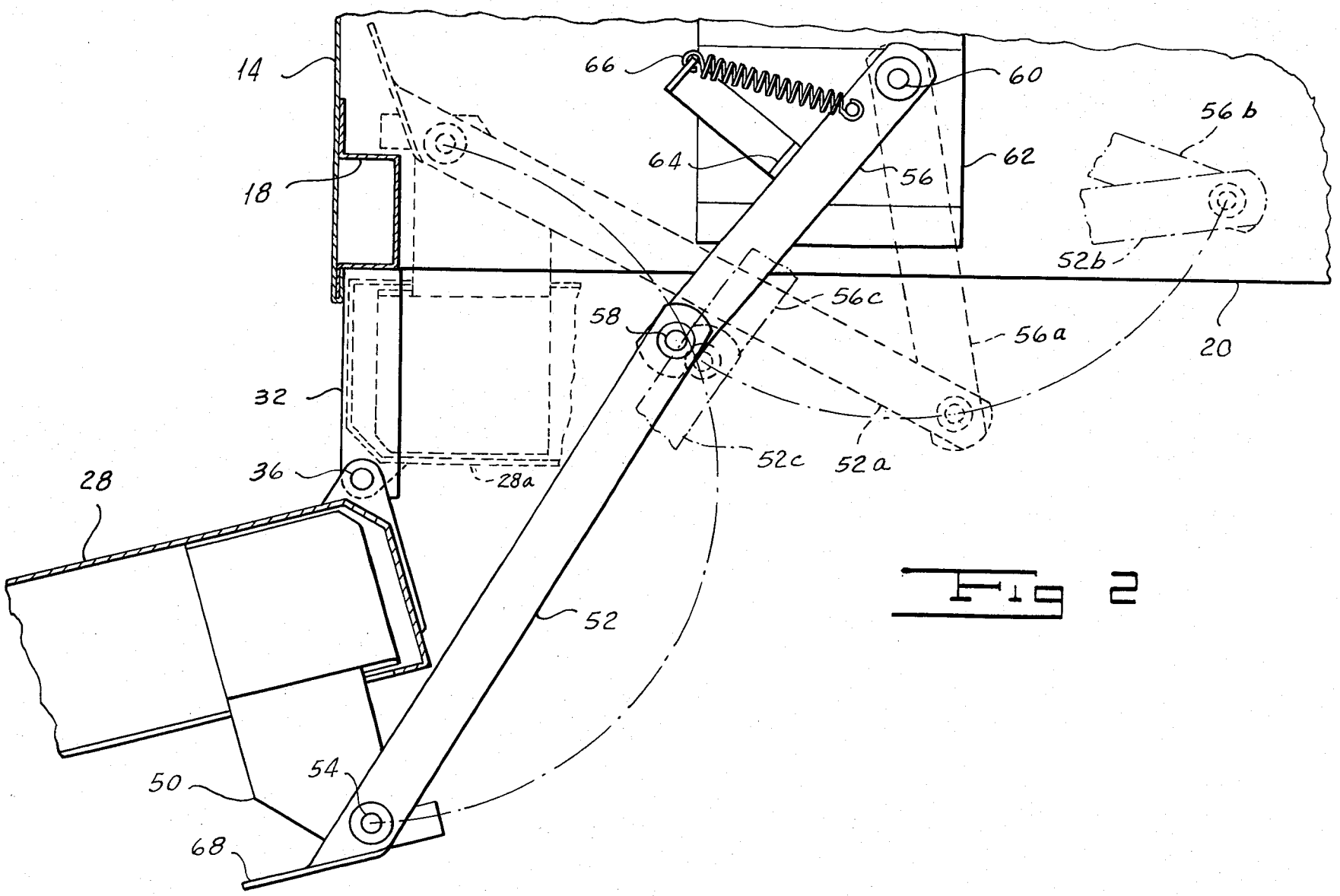
FIG. 2 is an enlarged fragmentary section of the machine shown in FIG. 1, taken along line 2—2 of FIG. 1, and drawn on an enlarged scale to illustrate my locking mechanism with the machine door open.
Figure 5:
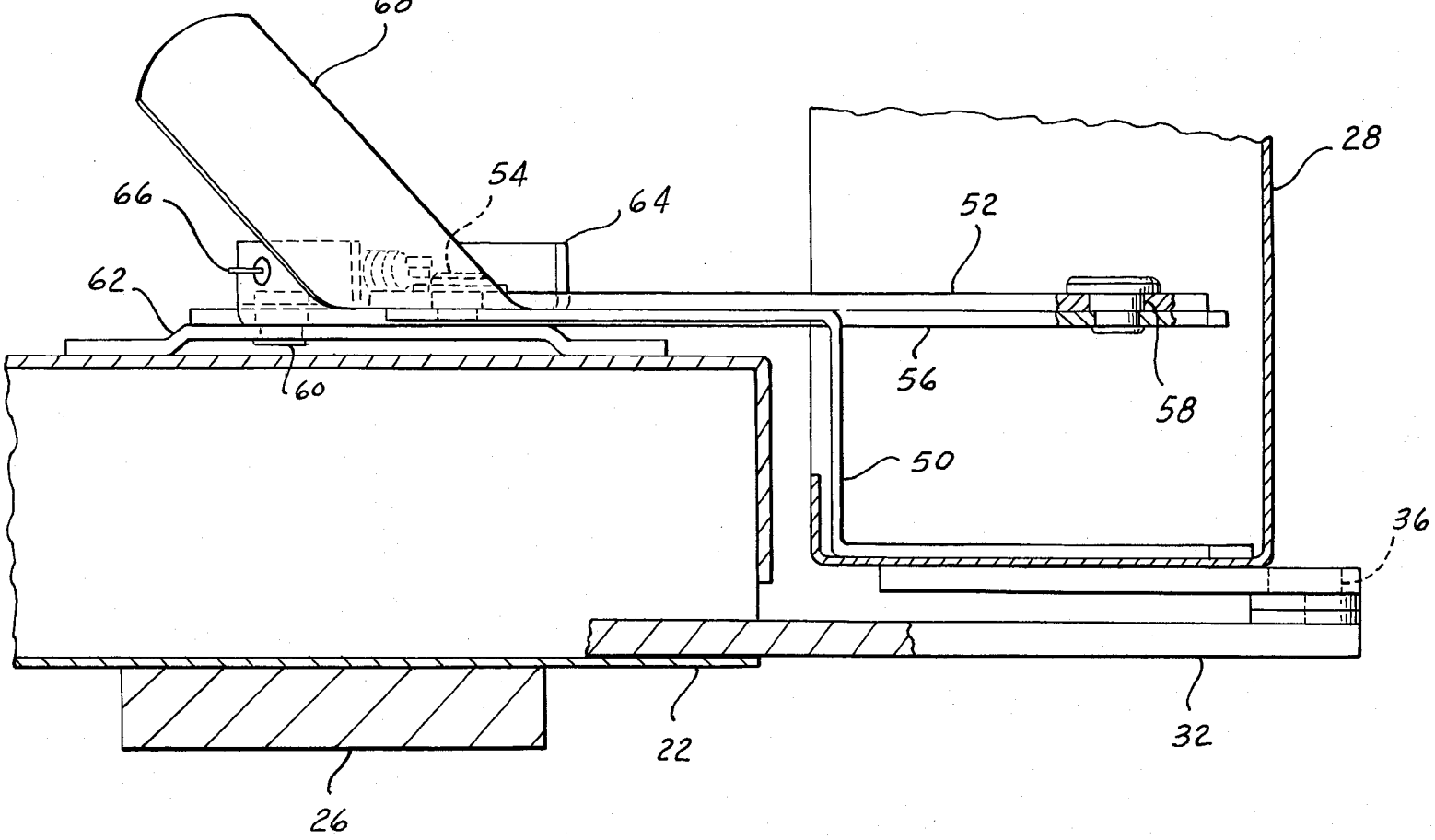

Referring now to FIGS. 2 and 3, a bracket 50 carried by the lower inner portion of the door 28 supports a first link 52 for movement around a pivot point defined by a pin 54. A bracket 62 carried by the bottom wall 20 supports a second link 56 for movement around a second pivot point defined by a pin 60. A third pivot pin 58 couples links 52 and 56 at the ends remote from pins 54 and 60. Link 52 is formed with an upwardly twisted end portion or extension 68 extending beyond pin 54. As shown in FIGS. 2 and 3, extension 68 is oriented at such an angle that pressure against the outer surface thereof in the open position of the door creates a movement around the pivot axis defined by pin 54, tending to move the linkage formed by links 52 and 56 from its locked position against the action of spring 66.

When the door 28 is swung away from the cabinet 12, links 52 and 56 move from a closed position **52*a*, 56*a* through an extreme position 52*b*, 56*b* at which pivot pin 54 is nearest pivot pin 60 to an aligned position 52*c*, 56*c* limiting further movement of the door 28 away from the cabinet 12. A spring 66 stretched between link 56 and a remote portion of a limit stop 64 biases the link 56 away from the aligned position 56***c*, in a direction opposite the direction from which arm 56 approached the aligned position 56*c*, to a locked position, shown in solid lines in FIG. 2, abutting the stop 64. Thus, when door 28 is open fully so as to move the arms 52 and 56 into their aligned position 52*c*, 56*c*, spring 66 pulls link 56, and hence link 52, into a locked position in which link 56 abuts the limit stop 64 to provide a self-locking toggle action. Attempts to force the door closed will only urge the link arm 56 more firmly against the limit stop 64. To release the link 52, 56 from their door-locking position, the person servicing the machine simply kicks the extension 68 in the direction of the door 28 with a sufficient force to move the links 52, 56 through their aligned position 52*c*, 56*c*, after which point the door 28 can be swung back to its closed position 28*a*. Since link 56 changes its direction of angular movement as it moves between the aligned position 56*c* and the closed position 56*a* (the direction change taking place at the extreme position 56*b*), spring 66 acts upon link 56 in such a direction as to maintain the link 56, and hence the door 28, in its closed position.

It will be seen that I have accomplished the objects of my invention. My mechanism locks the door of a merchandising machine in an open position away from the cabinet. My locking mechanism operates automatically when the door is fully opened and is readily releasable from its locking position. It will be understood that certain features and subcombinations are of utility and may be employed without reference to other features and subcombination. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a merchandising machine including a cabinet and a door providing access to the interior of the cabinet, said door being pivotally attached to the cabinet for movement away from said cabinet in a certain angular direction around a vertical pivot axis, the improvement comprising first and second link arms respectively pivotally coupled to lower portions of the door and the cabinet at first and second pivot points and pivotally interconnected at a third pivot point for movement from a position at which said door is closed to a position in which said pivot points are aligned, means for preventing the movement of said second arm in said angular direction past a locking position beyond said aligned position, and means for biasing said arms from said aligned position into said locking position, said first arm including an extension on the other side of said first pivot point from said second arm to permit ready kick release of said arms from said locking position.

2. In a merchandising machine including a cabinet and a door providing access to the interior of said cabinet, said door being pivotally attached to the cabinet for movement away from said cabinet in a certain angular direction around a vertical pivot axis, the improvement comprising first and second link arms respectively pivotally coupled to the door and to the cabinet at first and second pivot points and pivotally interconnected at a third pivot point for movement from a position at which said door is closed to a position in which said pivot points are aligned, means for preventing the movement of said arms past a locking position beyond said aligned position, and means for biasing said arms from said aligned position into said locking position, said biasing means exerting a torque on said second arm around said second pivot point in said certain angular direction.

3. In a merchandising machine including a cabinet and a door providing access to the interior of said cabinet, said door being pivotally attached to the cabinet for movement around a vertical pivot axis, the improvement comprising first and second link arms respectively pivotally coupled to the door and to the cabinet at first and second pivot points and pivotally interconnected at a third pivot point for movement from a position at which said door is closed to a position in which said pivot points are aligned, a stop disposed in such a position as to abut one of said arms as it is moved beyond said aligned position, and means for biasing said arms from said aligned position into a locking position defined by said stop.

4. In a merchandising machine including a cabinet and a door providing access to the interior of said cabinet, said door being pivotally attached to the cabinet for movement around a vertical pivot axis, the improvement comprising first and second link arms respectively pivotally coupled to the door and to the cabinet at first and second pivot points and pivotally interconnected at a third pivot point for movement from a position at which said door is closed to a position in which said pivot points are aligned, means for preventing the movement of said arms past a locking position beyond said aligned position, and a tension spring coupled between said second arm and a fixed portion of said cabinet, said spring biasing said arms from said aligned position into said locking position.

5. In a merchandising machine including a cabinet and a door providing access to the interior of said cabinet, said door being pivotally attached to the cabinet for movement around a vertical pivot axis, the improvement comprising first and second link arms respectively pivotally coupled to the door and to the cabinet at first and second pivot points and pivotally interconnected at a third pivot point for movement from a position at which said door is closed to a position in which said pivot points are aligned, means for preventing the movement of said arms past a locking position beyond said aligned position, said arms being so constructed and arranged that said second arm moves in a certain angular direction from said closed position to an intermediate position and then in an opposite angular direction from said intermediate position to said aligned position, and means for biasing said second arm in said opposite angular direction to urge said second arm into said closed position and to urge said arms from said aligned position into said locking position.

6. In a merchandising machine including a cabinet and a door providing access to the interior of said cabinet, said door being pivotally attached to the cabinet for movement around a vertical pivot axis, the improvement comprising first and second link arms respectively pivotally coupled to the door and to the cabinet at first and second pivot points and pivotally interconnected at a third pivot point for movement from a position at which said door is closed to a position in which said pivot points are aligned, means for preventing the movement of said arms past a locking position beyond said aligned position, one of said arms including an extension at the end remote from said third pivot point.

7. In a merchandising machine including a cabinet and a door providing access to the interior of said cabinet, said door being pivotally attached to the cabinet for movement around a vertical pivot axis, the improvement comprising first and second link arms respectively pivotally coupled to the door and to the cabinet at first and second pivot points and pivotally interconnected at a third pivot point for movement from a position at which said door is closed to a position in which said pivot points are aligned, means for preventing the movement of said arms past a locking position beyond said aligned position, and means for biasing said arms from said aligned position into said locking position.

* * * * *